United States Patent [19]

Doran

[11] Patent Number: 4,967,528

[45] Date of Patent: Nov. 6, 1990

[54] CONSTRUCTION BLOCK

[76] Inventor: William E. Doran, 524 Via Almar, Palos Verdes Estates, Calif. 90274

[21] Appl. No.: 495,615

[22] Filed: Mar. 19, 1990

Related U.S. Application Data

[63] Continuation-in-part of Ser. No. 20,668, Mar. 2, 1987, abandoned.

[51] Int. Cl.[5] ..... E04B 2/00

[52] U.S. Cl. ..... 52/309.12; 52/426; 52/562

[58] Field of Search ..... 52/309.7, 309.8, 309.9, 52/309.11, 309.12, 562, 565, 424, 426, 428

[56] References Cited

U.S. PATENT DOCUMENTS

| | | | |
|---|---|---|---|
| 3,475,873 | 11/1969 | Steadman | 52/562 |
| 3,782,049 | 1/1974 | Sachs | 52/309.12 |
| 4,516,372 | 5/1985 | Grutsch | 52/309.12 |

FOREIGN PATENT DOCUMENTS

| | | | |
|---|---|---|---|
| 1037105 | 8/1958 | Fed. Rep. of Germany | 52/309.12 |

*Primary Examiner*—Richard E. Chilcot, Jr.
*Attorney, Agent, or Firm*—Jack C. Munro

[57] ABSTRACT

A construction block to be used with other similar blocks in order to construct panels of a building which is formed of a pair of substantially planar panels located in juxtaposition and spaced apart forming a space between the panel. Within the space between the panel, there is to be poured a quantity of uncured wet aggregate and cement mixture which is then to harden into a solid mass. Each of the panels is to be constructed of expanded polystyrene beads. The panels are secured together through a metallic tie rod assembly which is located principally in the space between the panels. The exterior surface of each of the panels includes a plurality of vertical grooves and within each groove is to be located a wooden strip which is to be penetrated by conventional fasteners to thereby mountingly secure a desired structural member onto an exterior surface of the construction block. A wire interconnecting frame is to be located in the space between the panels and across the joint of a pair of connected blocks to provide lateral support for the joint.

6 Claims, 2 Drawing Sheets

CONSTRUCTION BLOCK

REFERENCE OF PRIOR APPLICATION

This application is a continuation-in-part of U.S. patent application Ser. No. 020,668, filed Mar. 2, 1987, now abandoned by the same inventor and same title.

BACKGROUND OF THE INVENTION

The field of this invention relates to construction and more particularly to a new and novel block which is to be utilized with other similar blocks in order to form a rigid wall.

Constructing of walls by utilizing of a mass of identical building blocks is well-known. Common forms of building blocks are bricks, cinder blocks an cement blocks. Bricks are formed of clay and produce an attractive exterior appearance without the adding of any additional structure. A cement block is advantageous over brick in that it is stronger and less expensive plus a better insulator against heat and moisture. Cinder block has a still further advantage in that it is a better insulator than a cement block and is also lighter in weight and therefore easier to handle. Normally, cinder block is less expensive than cement block. The common way a wall is constructed by using the aforementioned building blocks is to mortar together the blocks in a stacked series of staggered rows.

There has long been a need to improve upon the features of the aforementioned building blocks. If a block could be constructed that would have better insulative features, it would therefore take less energy to heat or cool the inside of the house or building constructed with such block. Also, if the block permitted constructing of a wall of less cost, again, this would be an exceedingly important feature when compared to the conventional type of building blocks. It would be necessary that the building block would be at least as strong as conventional types of building blocks.

SUMMARY OF THE INVENTION

The structure of this invention is related to a construction block which utilizes a pair of substantially planar walls which are located side-by-side but in a spaced apart manner forming a space therebetween. The panels are identical and located in a reversed relationship. The panels are tied together by a metallic tie rod assembly. This tie rod assembly fixes the spacing between the panels. The peripheral edge of the panels defines an interlocking tongue and groove arrangement so as to facilitate securement to abutting blocks. The exterior surfaces of the panels, one of which is used to define the interior wall of the building or house with the other exterior surface to define the exterior wall of the building or house, are each to include a plurality of vertically oriented spaced apart grooves. Within each groove is to be located a wooden strip. The tie rod assembly is to connect to these wooden strips. The function of these wooden strips is to facilitate mounting of desired structural members onto both the formed interior wall and exterior wall of the resultingly formed wall memeber utilizing the construction block of the present invention. A desired structural member would be plasterboard or wire netting in order to facilitate stuccoing or other similar types of structural members. Located interiorly and across the joint of an aligned pair of the blocks is a wire interconnecting frame. This frame is partially embedded in the panels. Tie rods are located directly adjacent each frame to laterally hold the panels together against the frame.

The primary objective of the present invention is to construct a strong construction block which is to be utilized to form walls of houses and buildings which will result in the wall or building having greater insulative properties than heretofore possible and also to construct a wall less expensively than using previously known conventional construction blocks.

DETAILED DESCRIPTION OF THE SHOWN EMBODIMENT

Figure 1:
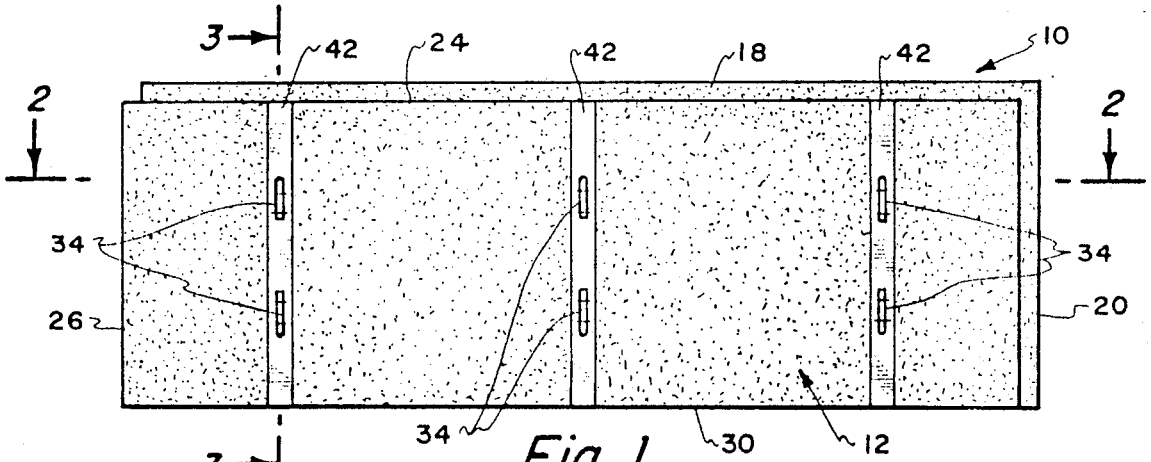
FIG. 1 is a front elevational view of the construction block of the present invention.

Referring particularly to the drawing there is shown the construction block 10 of this invention which is composed primarily of a sheet material panel 12 and a sheet material panel 14. Panels 12 and 14 are identical to each other but are located in a reversed side-by-side relationship forming a space 16 therebetween. The basic material of construction of the panels 12 and 14 will be expanded polystyrene beads.

Each of the panels 12 and 14 assumes a basic rectangular configuration. Although the size of the panels 12 and 14 can be readily varied, it is normally considered to be feasible to have each panel to be of a length of approximately four feet with a height of sixteen inches. The depth of each panel will generally be between two to six inches. The block 10 will produce a wall thickness between eight and eighteen inches with a space 16 thickness of four to six inches.

Each of the panels 12 and 14 has on its upper edge an elongated ridge 18. A similar elongated ridge 20 is formed on the right side of each of the panels 12 and 14. Directly adjacent each of the ridges 20 is an elongated groove 22. Directly adjacent each of the elongated ridges 18 is an elongated groove 24.

It is to be understood that on the left side of the panels 12 and 14 there is an elongated ridge 26. Directly adjacent each of the ridges 26 is an elongated groove 28. Within the bottom peripheral edge of the panels 12 and 14 there is located a pair of elongated ridges 30 with each ridge 30 being located directly adjacent an elongated groove 32.

Figure 2:
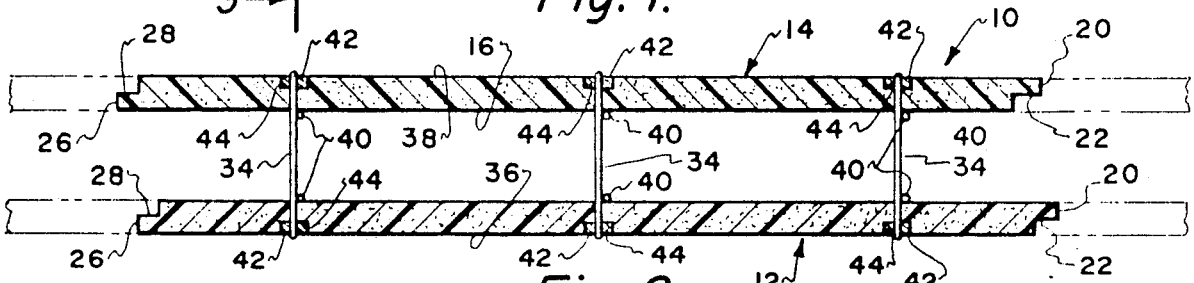
FIG. 2 is a cross-sectional view taken along line 2—2 of FIG. 1.
Figure 3:
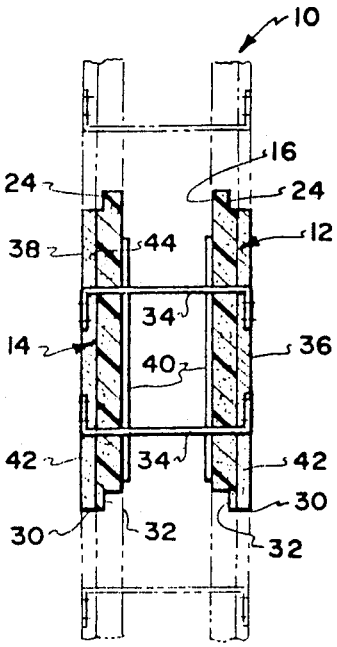
FIG. 3 is a cross-sectional view taken along line 3—3 of FIG. 1.

It is to be understood that, referring particularly to FIG. 2, by turning around panel 12 ridge 20 becomes ridge 26 and the groove 22 becomes groove 28 (panel 12 then becomes panel 14). Also, in referring to FIG. 2, it can be seen that the position of panels 12 and 14 is such that there is a slightly staggered condition with panel 14 being located approximately one inch further left of panel 12. The reason for this is that ridges 20 of another block 10 are to be located within the grooves 28. Also, the ridges 26 of another block 10 are to be positioned within the grooves 22. This staggering relationship enhances a secure interlocking between directly adjacent blocks 10 facilitating the producing of a ridge wall structure. Also, it is considered to be within the scope of this invention that adhesive could be applied between the joined surfaces of the blocks 10. The ridges 20 are located at one end of block 10 with ridges 26 located at the opposite end of block 10. When ridges 20 of a block 10 engage with grooves 28 of another block 10, a joint is formed.

The panel 14 is fixed in position relative to the panel 12 by means of a tie rod assembly. This tie rod assembly is composed of a plurality of spaced apart horizontal tie rods 34. The horizontal tie rods 34 penetrate through the panels 12 and 14 and connect with the exterior wall surfaces 36 and 38, respectively, of the panels 12 and 14. It is to be noted that there six in number of the horizontal tie rods 34 shown for a given block 10. However, this number can be increased or decreased without departing from the scope of this invention.

Securely fixed, as by welding, between pair of vertically aligned tie rods 34 are a pair of vertical tie rods 40. It is to be noted that there are two in number of vertical tie rods 40 for each vertically aligned pair of horizontal tie rods 34. This means that for the block 10 there are six in number of the vertical tie rods 40. One-half of the vertical tie rods 40 abut against the interior wall surface of the block 10 with the remaining one-half of vertical tie rods 40 abutting against the interior wall surface of the panel 14. These vertical tie rods 40 maintain the panels 12 and 14 in their spaced relationship to each other so that the space 16 always remains at a precise spacing.

The free or outer end of the horizontal tie rods 34 pass through a wooden strip 42. The end of each of the tie rods 34 is then bent over to a right angle configuration and flush with the outer surface of each of the wooden strips 42. Each of the wooden strips 42 are mounted in a close conforming manner within a groove 44. Again, the strips 42 may also be adhesively secured within their respective groove 44.

When a wall is constructed with the building block 10 of the present invention, a horizontal row is formed with the interlocked blocks 10. A quantity of wet uncured aggregate and cement (not shown) is then poured to substantially fill the space 16. As this aggregate and cement cures, a solid rigid structural unit is formed within the space 16 with the horizontal tie rods 34 being embedded within the cured aggregate mixture. As a result an extremely strong rigid wall is obtained by filling of the space 16 of the assembled blocks 10 with this aggregate/cement mixture providing the necessary strength for the resulting produced wall. The desirable insulating qualitities are obtained through the use of the expanded polystyrene material of the panels 12 and 14. In order to facilitate the mounting of structural members such as plasterboard and the like on the surfaces 36 and 38, it is only necessary that such plasterboard be nailed directly to each of the strips 42.

Figure 4:
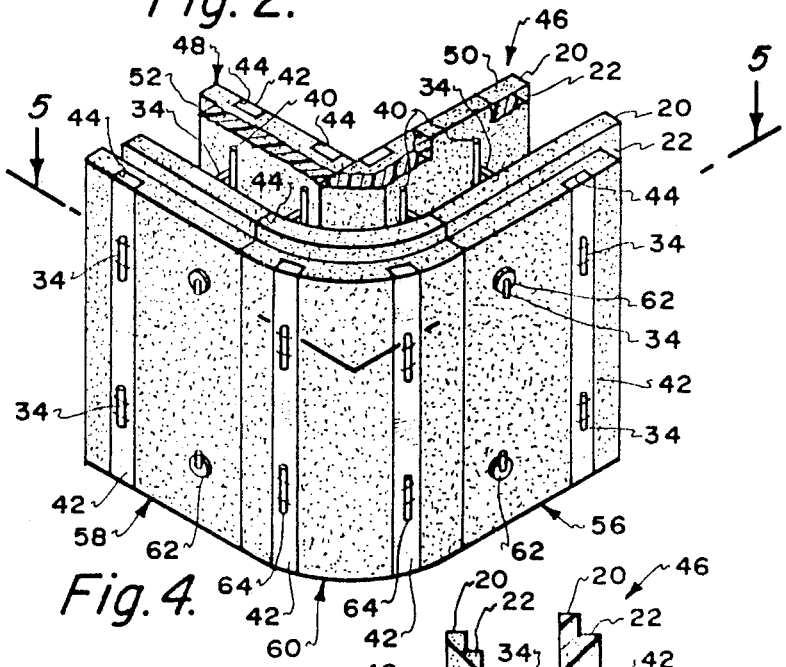
FIG. 4 is an isometric view of a corner block constructed utilizing the inventive features of the construction block of the present invention.
Figure 5:
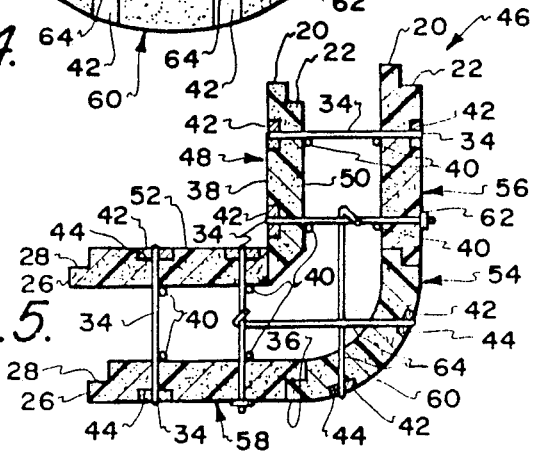
FIG. 5 is a cross-sectional view taken alone line 5—5 of FIG. 4.

Referring particularly to FIGS. 4 and 5, there is shown a corner block 46 which is to be utilized in conjunction with the blocks 10 in order to produce a ninety degree corner section. Like numerals have been utilized to refer to like parts. The only difference in the corner block 46 is that the inside panel 48 is formed of two ninety degree edge abutting sections 50 and 52. The outside panel 54 is formed of two lineal sections 56 and 58 which are interlocked together by a curved section 60. Some of the horizontal tie rods 34 do not connect with strips 42 but instead connect with washers 62 mounted against the exterior wall surface 36. There will also be normally included tie rods 64 which connect with the strips 42 formed within the corner section 60. The inner end of the tie rods 64 are secured to horizontal tie rods 34. It is the tie rods 64 that function to hold the corner section 60 is the fixed position.

Figure 6:
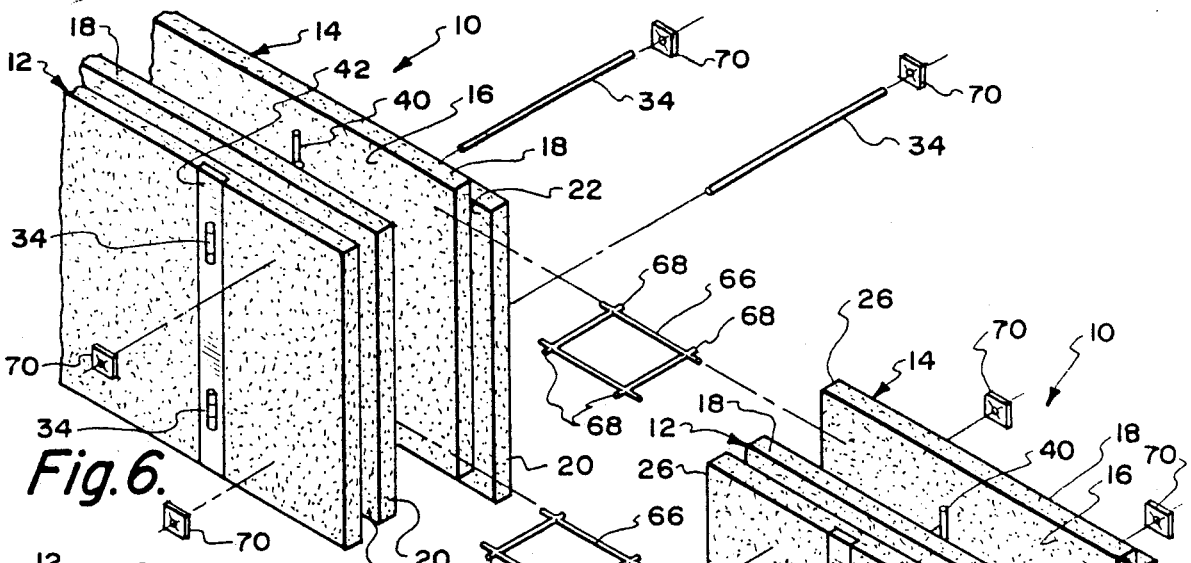
FIG. 6 is an isometric view of a pair of (to be joined) construction blocks of the present invention showing the construction blocks separated and with a wire frame to be utilized to connect together these constructions blocks.
Figure 7:
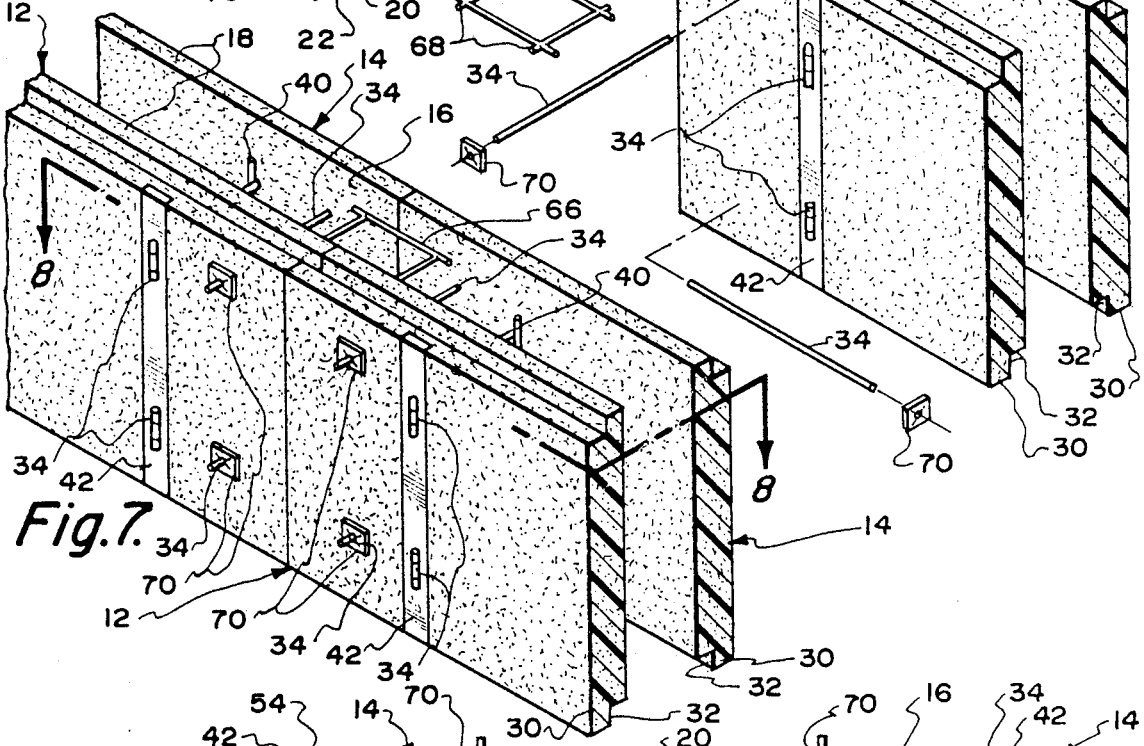
FIG. 7 is an isometric view of the now joined together construction blocks of FIG. 6.
Figure 8:
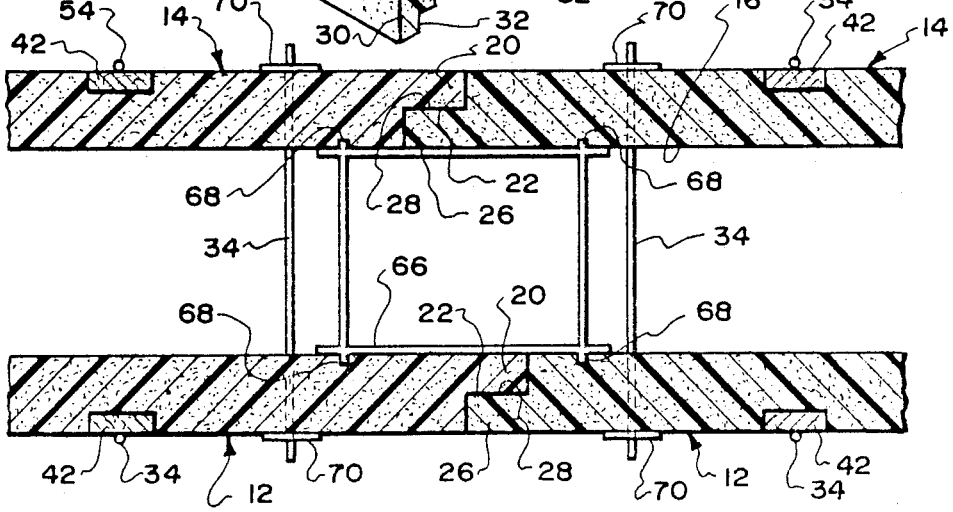
FIG. 8 is a cross-sectional view through the joined construction blocks of FIG. 7 taken along line 8—8 of FIG. 7.

Referring particularly to FIGS. 6 to 8 of the drawings, there is shown a rectangularly shaped wire frame 66. Wire frame 66 has four in number of laterally protruding nodules 68. Basically, a nodule 68 is located directly adjacent each corner of the wire frame 66.

When two of the blocks 10 are aligned and are to be jointed together, a pair of the frames 66 are to be mounted in vertical alignment with each other and located across the interconnecting joint between the joined blocks 10. This arrangement is clearly shown within FIGS. 7 and 8 of the drawings. One of the nodules 68 is to slightly be embedded within the inside surface of a panel 12 with another one of the nodules 68 being embedded within the inside wall surface of a panel 14 to which that panel 12 is connected. In a similar manner, the remaining two nodules 68 embed within the inside wall surface of the remaining pair of panels 12 and 14. One of the frames 66 is to be located directly adjacent the top edge of the blocks 10 with the remaining wire frame 66 being located directly adjacent the bottom edge of the block 10. The fact that the wire frames 66 are located across the joined edge between the blocks 10 provides an additional lateral stability across this joint.

Associated with each wire frame 66 are a pair of the tie rods 34 with one tie rod 34 being conducted through one connected arrangement of panels 12 and 14 and the remaining tie rod 34 being conducted through the remaining pair of the panels 12 and 14. Each end of each tie rod 34 is connected with a clip 70. Each clip 70 is constructed so that it can be pushed onto an end of the tie rod 34 and once so engaged can slide inward but not outward. Therefore, once the clip 70 is installed, it is permanently installed and each clip 70 is to be snugly moved into contact with its respective panel 12 or 14. Therefore, the tie rods 34 associated with the clip 70 and the frames 66 provide the desired lateral support at the joining between a pair of the blocks 10 so that when the aggregate is poured into the space 16 that joint between the blocks 10 will not separate.

What is claimed is:

1. A construction block comprising:

a pair of substantially planar panels located in juxtaposition and spaced apart forming a space between said panels, each said panel having an interior surface, said interior surfaces forming the walls of said space, said space being adapted to receive a quantity of uncured wet aggregate and cement mixture, said panels being of the same length and the same height, each said panel having a peripheral edge including an upper edge and a bottom edge and side edges, each said peripheral edge having means for interlocking with another said construction block permitting vertical stacking of said construction blocks so said upper edge of one said construction block connecting with said bottom edge of another said construction block and said side edges of horizontally aligned said construction blocks interlock forming a joint;

a tie rod assembly secured to said panels, said tie rod assembly including a plurality of horizontal tie rods and a plurality of vertical tie rods, said horizontal tie rods to extend across said space, said vertical tie rods to abut against said interior surfaces for defining the spacing between said panels, said tie rod assembly including a separate enclosing wire frame, said wire being substantially rectangular said wire frame located within said space and located across said joint;

each said panel having an exterior surface, a plurality of spaced apart grooves formed within said exterior surface of each said panel, said grooves extending between said upper edge and said bottom edge; and a strip located within each said groove, each said strip being connected to said horizontal tie rods of said tie rod assembly, each said strip being fixedly secured to its respective said panel by said horizontal tie rods, each said strip being constructed of a material penetratable by nails with said material holding tightly onto the nails to thereby mountingly secure a desired structural member onto said exterior surface of said construction block.

2. The construction block as defined in claim 1 wherein:

said tie rod assembly comprising a plurality of metallic rods.

3. The construction block as defined in claim 2 wherein:

said wire frame having a plurality of nodules, a said nodule being embedded within said interior surface of each said panel thereby fixing the position of said wire frame on said panels.

4. The construction block as defined in claim 3 wherein:

there being a plurality of said wire frames for each said joint.

5. The construction block as defined in claim 4 wherein:

there being at least a pair of said horizontal tie rods mounted directly adjacent said wire frame with said horizontal tie rods being restrained at their ends to prevent lateral movement of said panels tending to enlarge said space.

6. The construction block as defined in claim 5 wherein:

each said strip being constructed of wood.

* * * * *